United States Patent [19]

Oguro et al.

[11] Patent Number: 4,961,021

[45] Date of Patent: Oct. 2, 1990

[54] CONVERGENCE APPARATUS AND CONVERGENCE YOKE USED THEREFOR

[75] Inventors: Hiroki Oguro; Nobutaka Okuyama; Masaki Nakahara, all of Yokohama, Japan

[73] Assignee: Hitachi, Ltd., Tokyo, Japan

[21] Appl. No.: 304,213

[22] Filed: Jan. 31, 1989

[30] Foreign Application Priority Data

Feb. 3, 1988 [JP] Japan ..... 63-21898

[51] Int. Cl.[5] ..... H01J 27/70; H01J 29/76

[52] U.S. Cl. ..... 313/412; 313/428; 313/440; 315/368; 335/213

[58] Field of Search ..... 313/412, 428, 431, 437, 313/433, 440; 315/368; 335/209, 210, 211, 212, 213, 214

[56] References Cited

U.S. PATENT DOCUMENTS 4,642,527 2/1987 Takahashi et al. ..... 313/412 X 4,725,763 2/1988 Okuyama et al. ..... 313/412 X

FOREIGN PATENT DOCUMENTS 58-32378 7/1983 Japan .

*Primary Examiner*—Kenneth Wieder

*Attorney, Agent, or Firm*—Antonelli, Terry, Stout & Kraus

[57] ABSTRACT

The disclosed relates to a convergence apparatus to be used for a single electron gun type cathode-ray tube, and relates to a convergence yoke to be used for the convergence apparatus. Each of two magnetic poles for generating a bipolar magnetic field is constituted by a first one of a plurality of core protrusions located on a horizontal or vertical axis and at least one pair of second ones of the plurality of core protrusions located at positions equiangularly and symmetrically deviated from the horizontal or vertical axis, and a ratio of an ampere turn of the coil wound on each of at least one pair of second core protrusions to an ampere turn of the coil wound on the first core protrusion is suitably changed. A firt magnetic auxiliary plate and a second magnetic auxiliary plate are provided on a first core protrusion constituting each of a first pair of magnetic poles and on a second core protrusion constituting each of a second pair of magnetic poles respectively. Each of the first and second magnetic auxiliary plates has a fork end projected along an axis perpendicular to a horizontal axis as well as a vertical axis. The first and second magnetic auxiliary plates have respective widths existing within an angular range symmetrically deviated by 45° from the horizontal axis and within an angular range symmetrically deviated by 45° from the vertical axis respectively. Each of the first and second magnetic auxiliary plates has a substantially Y-shaped and axisymmetrical form.

16 Claims, 9 Drawing Sheets

CONVERGENCE APPARATUS AND CONVERGENCE YOKE USED THEREFOR

BACKGROUND OF THE INVENTION

The present invention generally relates to a convergence apparatus and a convergence yoke to be used for the convergence apparatus. The present invention particularly relates to a convergence apparatus in which it is possible to prevent an electron beam spot from deteriorating at the time of convergence correction to thereby provide a good focusing performance, and a convergence yoke to be used for such a convergence apparatus.

In a color display of a projection type color television receiver, a plurality of single-electron-gun type cathode-ray tubes are used and monochromatic images of red (R), green (G), and blue (B) of the respective cathode-ray tubes are projected on a projection screen through an optical system composed of a reflection mirror, a lens, etc., so as to form a color picture on the screen. At this time, in each cathode-ray tube, an electron beam is deflected by a substantially even magnetic field type deflection yoke and image carrying light of the cathode-ray tube is projected on a projection screen 101 (FIGS. 1 and 2) through an optical system, so that a pincushion distortion 102 as shown in FIG. 1 or a trapezoidal or keystone distortion 103, 103' as shown in FIG. 2 appears on the projection screen 101.

In order to correct such a distortion, conventionally, a convergence apparatus has been provided in each cathode-ray tube. Such a convergence apparatus is constituted by a convergence yoke and a convergence circuit, the convergence yoke being provided in the electron-gun side rear of a deflection yoke. The convergence yoke has a core composed of a ring-like portion and four or two-pairs of rectangular core protrusions, each pair being located on the horizontal and vertical axes respectively and inward projected from the ring-like portion. The convergence circuit makes a convergence correction current $i_c$ flow into coils wound on the core protrusions in synchronism with a horizontal deflection current $i_H$ or a vertical deflection current $i_v$ as shown in FIG. 3 so as to generate a horizontal bipolar magnetic field between the one pair of core protrusions (magnetic poles) located on the horizontal axis at positions opposite to each other and a vertical bipolar magnetic field between the other pair of core protrusions (magnetic poles) located on the vertical axis at positions opposite to each other, so that vertical and horizontal deflection forces are exerted on the electron beam to correct the above-mentioned pincushion distortion 102 or the keystone distortion 103, 103'.

Alternatively, as is shown in FIG. 6 of Japanese Utility Model Publication No. 58-32378, there has been proposed another example of a core of a convergence yoke in which an 8-pole core having two pairs of a first set of four core protrusions located on the horizontal and vertical axes respectively and a second set of four core protrusions positioned at circumferentially intermediate angular positions between adjacent ones of the first set of four core protrusions, and in which an AC current is made to flow in coils wound on the first set of four core protrusions to perform dynamic convergence correction (that is, correction of the foregoing pincushion distortion 102 or the keystone distortion 103, 103') and a DC current is made to flow in coils wound on the second set of four core protrusions so as to perform static correction.

In the prior art, as described above, there have been two examples of a convergence yoke of a convergence apparatus, one example being a case ① in which horizontal and vertical bipolar magnetic fields are generated by two pairs of core protrusions positioned on the horizontal and vertical axes respectively, the other example being a case ② in which horizontal and vertical bipolar magnetic fields are generated by four core protrusions positioned at circumferentially intermediate angular positions between the horizontal and vertical axes (that is, positions angularly deviated, for example, by 45° or the like from the horizontal and vertical axes). The respective shapes of the horizontal and vertical bipolar magnetic fields in the foregoing cases, that is, the shapes of magnetic fields acting on an electron beam, will be described hereunder.

First, the former case ① will be described by using FIG. 4.

FIG. 4 is a sectional view showing a example of a convergence yoke in a conventional convergence apparatus.

In FIG. 4, reference numerals 6 and 7 designate vertical and horizontal bipolar magnetic fields (N, S) respectively; **15*b* and 15*b'* designate horizontal deflection coils; 16*a* and 16*a'* designate vertical deflection coils; 17, 17' and 18, 18' designate input terminals; 50** designates a core; and a, a' and b, b' designate core protrusions.

As is apparent from FIG. 4, in the case where a bipolar magnetic field in the horizontal direction (x-direction) is generated by the pair of core protrusions a and a' provided on the horizontal axes and another bipolar magnetic field in the vertical direction (y-direction) is generated by the pair of core protrusions b and b' provided on the horizontal axes, the qualitative shape of each of the resultant bipolar magnetic fields shows a section of a glass tube through which the electron beam passes.

Since the convergence yoke has a structure symmetrical with respect to the x-axis as well as the y-axis as shown in FIG. 4, description will be made hereunder only about the vertical bipolar magnetic field (the horizontal convergence correcting magnetic field $B_y$).

The horizontal convergence correcting magnetic field $B_y$ is expressed by the following expression (1).

$$B_y = B_0 + B_2 \cdot x_2]10^{-4}T] \ldots \quad (1)$$

where x represents an amount of deviation in the horizontal direction (x-direction) from a reference, that is, a tube axis (an axis perpendicular to the paper plane and passing through the intersection of the horizontal and vertical axes in FIG. 4), $B_0$ represents the magnetic flux density on the tube axis, and $B_2$ represents a value expressed as follows.

$$B_2 = \frac{\{B(x) + B(-x)\}/2 - B_0}{x^2} \quad (2)$$

where B(x) represents the magnetic flux density at a position deviated in the horizontal direction by x from the tube axis, and B(−x) represents the magnetic flux density at a position deviated in the horizontal direction by −x from the tube axis.

Although actual magnetic flux density contains higher order components of even number degree four or more ($x^4$, $x^6$, $x^8$, . . . ) with respect to x, those components are omitted in the above expression (1).

In the above expression (1), $B_2$ represents an uneven magnetic field component of the vertical bipolar magnetic field 6.

FIG. 5 is an explanatory diagram showing, along a tube axis, a distribution of an uneven magnetic field component of a bipolar magnetic field generated in the conventional convergence yoke of FIG. 4.

In FIG. 5, the abscissa represents the coordinate Z in the direction of tube axis (in the direction perpendicular to the paper plane in FIG. 4), and the axis of ordinates represents the value of $B_2/B_{0max}$ which is obtained by normalizing the uneven magnetic field component $B_2$ with the maximum value $B_{0max}$ of the magnetic flux density $B_0$ on the tube axis. The reference numeral 13 represents the distribution curve of the value of $B_2/B_{0max}$, and 14 represents the position, on the tube axis, of the core 50 of the convergence yoke in FIG. 4. In this case, it is considered that the distribution curve of the value of $B_2/B_{0max}$ may take the following three states (a), (b) and (c).

(a) The case where both the $B_2$ and $B_0$ take positive values:

$B_2>0$ and $B_0>0$ so that $B_2/B_{0max}$ takes a value in the positive region in FIG. 5 and therefore $B_2/B_0>0$ and $B_0<B(x)$. Accordingly, the magnetic field becomes a pincushion magnetic field.

(b) The case where $B_2$ takes a negative value, while $B_0$ takes a positive value:

$B_2<0$ and $B_0>0$ so that $B_2/B_{0max}$ takes a value in the negative region in FIG. 5 and therefore $B_2/B_0<0$ and $B_0>B(x)$. Accordingly, the magnetic field becomes a barrel magnetic field.

(c) The case where $B_2$ becomes zero:

$B_2=0$ and $B_2/B_0=0$, so that $B_2/B_{0max}$ takes a value on the abscissa in FIG. 5 and therefore the magnetic field becomes an even one.

As seen from FIG. 5, in the case where horizontal and vertical bipolar magnetic fields are generated by two pairs of core protrusions positioned on the horizontal and vertical axes respectively, the magnetic fields become like a barrel over the whole region in the direction of the tube axis and the barrel shape becomes most remarkable at a central position A of the convergence yoke.

FIG. 6 is a partly broken side view of a cathode-ray tube and peripheral devices and FIG. 7 is an explanatory diagram showing a state in which a shape of an electron beam spot is distorted by a barrel magnetic field component of a bipolar magnetic field generated in the convergence yoke of FIG. 4.

In FIG. 6, the reference numeral 32 represents a cathode-ray tube, 33 represents a fluorescent screen, 34 represents a horizontal deflection coil, 35 represents a vertical deflection coil, 36 represents a deflection yoke core, 37 represents a deflection yoke, 38 represents a deflection circuit, 39 represents a convergence yoke, 40 represents a convergence circuit, 41 represents a centering magnet, 42 represents a cathode-ray tube wall, and 43 represents an electron gun.

As shown in FIG. 6, the convergence yoke 39 is positioned in the electron-gun side rear of the deflection yoke 37 so that a bipolar magnetic field in the vertical (horizontal) direction is exerted on an electron beam. If such a barrel magnetic field as described above is exerted on an electron beam in this configuration, the shape of a spot 29 of the electron beam is triangularly distorted as indicated with a reference numeral 30 in FIG. 7 to thereby deteriorate the focusing performance. That is, the reference numerals 29 and 30 designate the shape of the spot of an electron beam before and after the electron beam enters the region of the convergence yoke, respectively.

Next, referring to FIG. 8, description will be made about the latter case ② in which horizontal and vertical bipolar magnetic fields are generated by four core protrusions positioned at circumferentially intermediate angular positions between the horizontal and vertical axes (that is, positions angularly deviated, for example, by 45° or the like from the horizontal and vertical axes).

FIG. 8 is a sectional view showing another example of a convergence yoke in a conventional convergence apparatus.

In FIG. 8, the reference numerals 24*a*, 24*a*′, 24*b* and 24*b*′ represent horizontal deflection coils; 25, 25′, 26 and 26′ input terminals; 27*a*, 27*a*′, 27*b* and 27*b*′ represent vertical deflection coils; and 51 represents a core.

As will be apparent from FIG. 8, in the case where horizontal and vertical bipolar magnetic fields 7 and 6 are generated by four core protrusions a, a′, b and b′ located at positions angularly deviated by 45° from the horizontal and vertical axes respectively, that is, in the case where each magnetic pole is constituted by adjacent two of the core protrusions which are positioned on the both sides of and deviated from each magnetic field symmetry axis and each bipolar magnetic field is generated between each pair of opposite magnetic poles (for example, the vertical bipolar magnetic field 6 is generated between one magnetic pole constituted by the two adjacent core protrusions a and b′ located on the both sides of the vertical axis which is the magnetic field symmetry axis and the other magnetic pole constituted by the two adjacent core protrusions a′ and b located on the both sides of the same vertical axis), the qualitative shape of each of the bipolar magnetic fields is like a pincushion.

FIG. 9 is an explanatory diagram showing, along a tube axis, a distribution of an uneven magnetic field component of a bipolar magnetic field generated in the conventional convergence yoke of FIG. 8.

As will be apparent in FIG. 9, the $B_2/B_{0max}$ distribution curve 13 exists in the positive region so that the magnetic field is a pincushion magnetic field in the certain region from the center of the core 51 in the direction of the tube axis.

The action of the convergence yoke forming such a pincushion magnetic field on an electron beam spot distorts the shape of the electron beam spot from a round one into a triangular one, on the contrary to the case of the foregoing barrel magnetic field, as shown in FIG. 10, resulting in deterioration in focusing performance.

SUMMARY OF THE INVENTION

It is therefore an object of the present invention to solve the foregoing problems in the prior art.

It is another object of the present invention to provide a convergence apparatus in which deterioration generated in electron beam spot at the time of convergence correction can be reduced so that the focusing performance can be improved.

It is a further object of the present invention to provide a convergence apparatus in which the deflection sensibility of the convergence yoke can be improved.

In order to attain the above objects, in the convergence apparatus according to an aspect of the present invention, each of two magnetic poles for generating a bipolar magnetic field is constituted by a first core protrusion located on a magnetic field symmetry axis (a horizontal or vertical axis) and at least one pair of second core protrusions located on positions equiangularly and symmetrically deviated by an angle $\theta$ from the magnetic field symmetry axis, and the value of ratio of an ampere turn of the coil wound on each of the second core protrusions to an ampere turn of the coil wound on the first core protrusion is selected to cos $\theta$. The term of "ampere turn" is defined as a product N·I of the number of turns N of a coil and a current I passing through the coil.

In the convergence apparatus according to another aspect of the present invention, each of two magnetic poles for generating a bipolar magnetic field is constituted by at least one pair of ones of a plurality of core protrusions located on positions equiangularly and symmetrically deviated from a horizontal or vertical axis, and in the case where a first pair of the core protrusions constituting each of the magnetic poles are located at position equiangularly deviated by an angle $\theta_1$ from the horizontal or vertical axis and the other or a second pair of the core protrusions constituting each of the magnetic poles are located positions equiangularly deviated by an angle $\theta$ from the horizontal or vertical axis, the ratio of an ampere turn of the coil wound on the second core protrusion to an ampere turn of the coil wound on the first core protrusion is selected to be $\cos\theta/\cos\theta_1$.

In the convergence apparatus according to a further aspect of the present invention, each of two magnetic poles for generating a bipolar magnetic field is constituted by only a pair of ones of a plurality of core protrusions located on positions equiangularly and symmetrically deviated by 30° from a magnetic field symmetry axis and the ampere turns of the respective coils wound on the pair of core protrusions are made equal to each other.

In the convergence apparatus according to a still further aspect of the present invention, a first magnetic auxiliary plate and a second magnetic auxiliary plate are provided on a first core protrusion constituting each of a first pair of magnetic poles and on a second core protrusion constituting each of a second pair of magnetic poles respectively. Each of the first and second magnetic auxiliary plates has a fork end projected along an axis perpendicular to a horizontal axis as well as a vertical axis. The first and second magnetic auxiliary plates have respective widths existing within an angular range symmetrically deviated by 45° from the horizontal axis and within an angular range symmetrically deviated by 45° from the vertical axis respectively. Each of the first and second magnetic auxiliary plates has a substantially Y-shaped and axisymmetrical form. The first magnetic auxiliary plate is made different from the second magnetic auxiliary plate in projecting direction of their fork end portions.

In the foregoing case where each of two magnetic poles for generating a bipolar magnetic field is constituted by a first core protrusion located on a magnetic field symmetry axis (a horizontal or vertical axis) and at least one pair of second core protrusions located on positions equiangularly and symmetrically deviated by an angle $\theta$ from the magnetic field symmetry axis, the barrel magnetic field component included in the magnetic field generated by means of the first core protrusions and the pincushion magnetic field component included in the magnetic field generated by means of the second core protrusions are canceled with each other so that the resultant bipolar magnetic field generated synthetically becomes substantially even.

In the foregoing case where each of two magnetic poles for generating a bipolar magnetic field is constituted by only a pair of ones of a plurality of core protrusions located on positions equiangularly and symmetrically deviated by 30° from a magnetic field symmetry axis, the second order component of the generated magnetic field is substantially zero so that the bipolar magnetic field becomes substantially even.

In the foregoing case where a magnetic auxiliary plate having a fork end projected along an axis perpendicular to a horizontal axis as well as a vertical axis, having a width existing within an angular range symmetrically deviated by 45° from a magnetic field symmetry axis, and having a substantially Y-shaped and axisymmetrical form is provided on a core protrusion constituting each of a pair of magnetic poles for generating a bipolar magnetic field, a part of the magnetic field distributed in the barrel-like shape from the core protrusion constituting the one of the two magnetic poles to the other passes through the magnetic auxiliary plate so as to increase the amount of the magnetic field passing through the magnetic paths at peripheral portions to make the second order component of the magnetic field have a tendency to become pincushion like, so that the resultant bipolar magnetic field generated synthetically is corrected to have a substantially even shape. In this case, further, the first and second magnetic auxiliary plates related to the bipolar magnetic fields in the direction of the horizontal and vertical axes respectively are made different from each other in projecting direction of their fork end portions, no ineffective magnetic paths are made by those first and second magnetic auxiliary plates so that the generated magnetic field acts on the electron beam effectively.

BRIEF DESCRIPTION OF THE DRAWINGS

Preferred embodiments of the present invention will now be described taken in connection with the accompanying drawings, in which.

DESCRIPTION OF THE PREFERRED EMBODIMENTS

Figure 1:
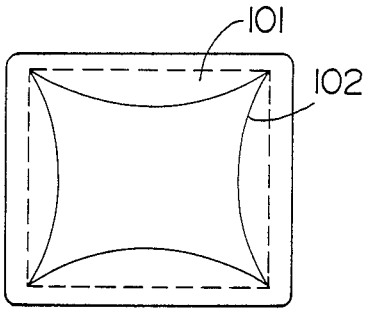
FIGS. 1 and 2 are diagrams showing distortion for explanation of the present invention.
Figure 2:
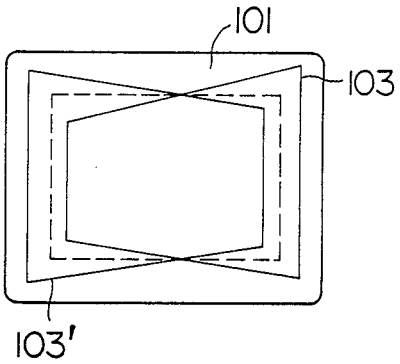
Figure 3:
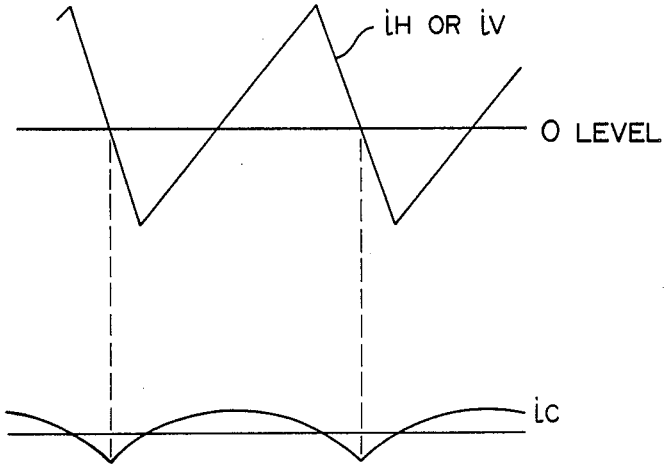
FIG. 3 is a waveform diagram of showing one example of a deflection current and a convergence correction current for explanation of the present invention.
Figure 4:
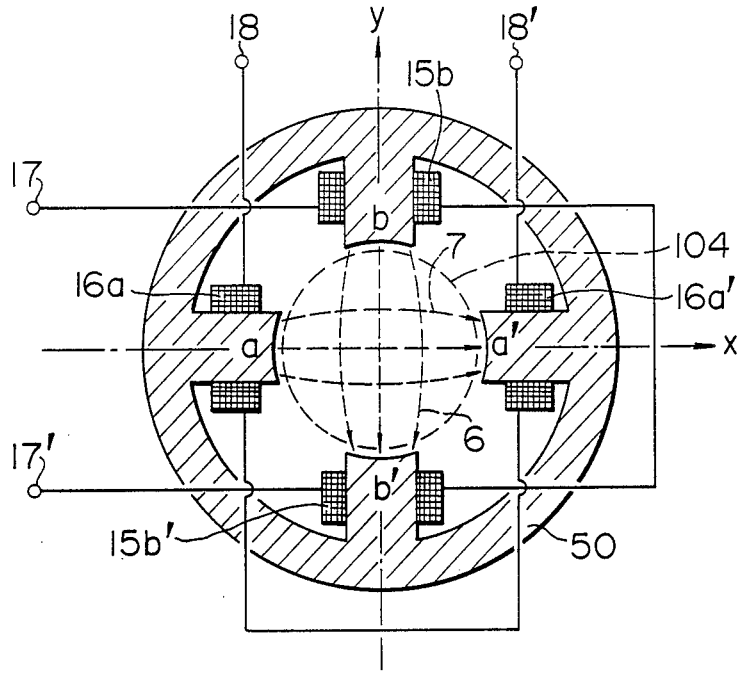
FIG. 4 PRIOR ART
FIG. 4 is a sectional view showing an example of a convergence yoke in a conventional convergence apparatus.
Figure 5:
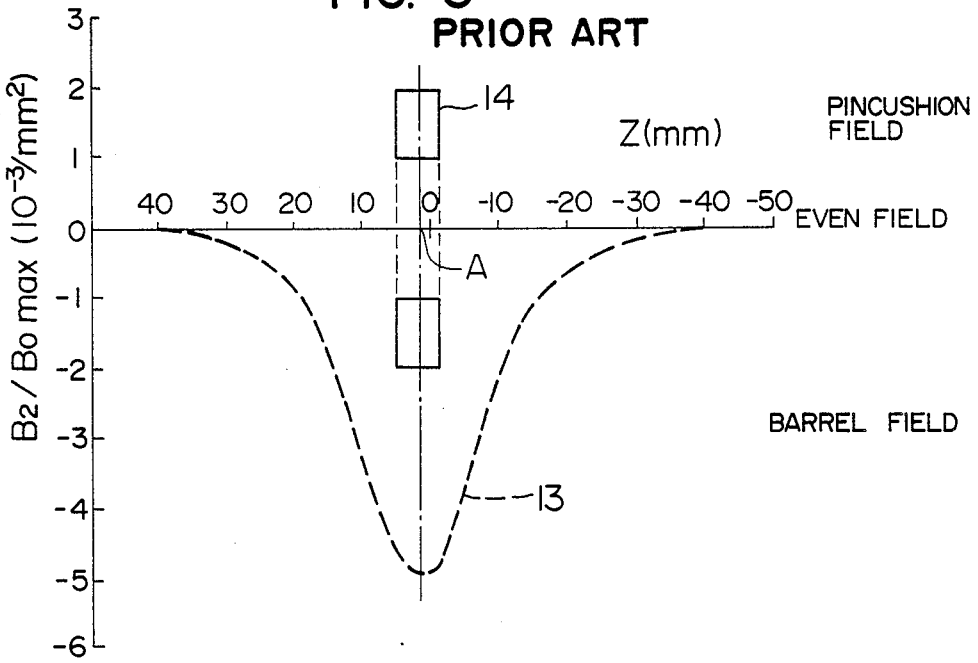
FIG. 5 PRIOR ART
FIG. 5 is an explanatory diagram showing, along an tube axis, a distribution of an uneven magnetic field component of a bipolar magnetic field generated in the conventional convergence yoke of FIG. 4.
Figure 6:
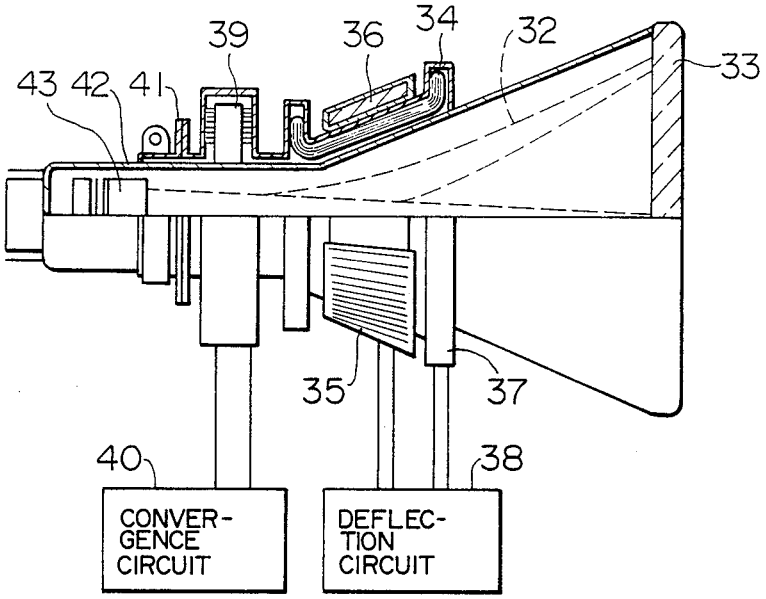
FIG. 6 PRIOR ART
FIG. 6 is a partly broken side view of a cathode-ray tube and peripheral devices.
Figure 8:
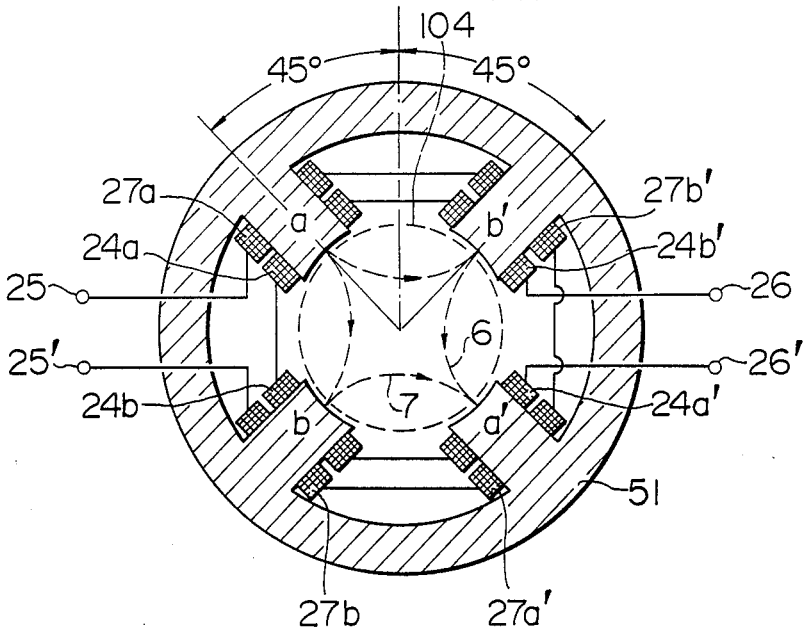
FIG. 8 PRIOR ART
FIG. 8 is a sectional view showing another example of a convergence yoke in a conventional convergence apparatus.
Figure 9:
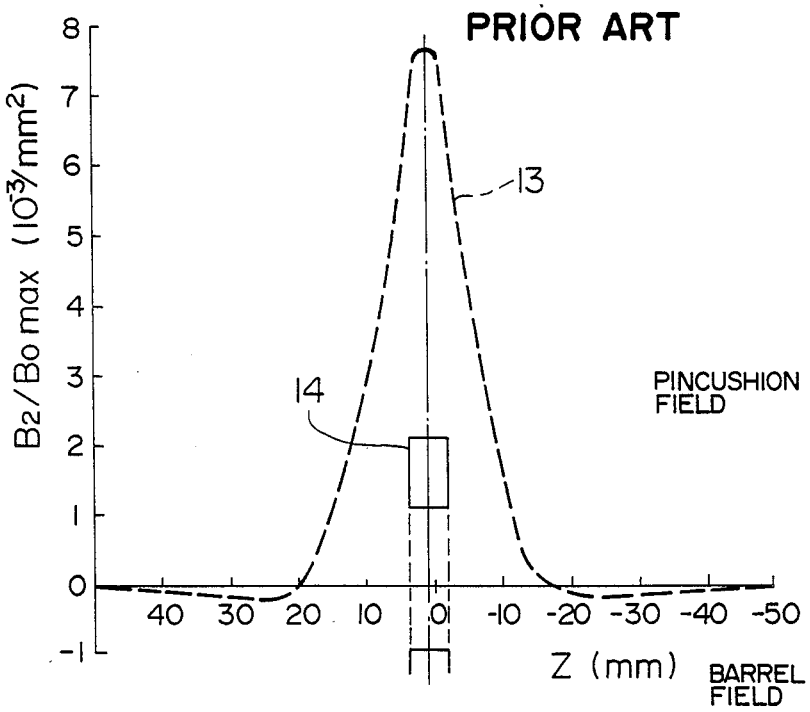
FIG. 9 PRIOR ART
FIG. 9 is an explanatory diagram showing, along an tube axis, a distribution of an uneven magnetic field component of a bipolar magnetic field generated in the conventional convergence yoke of FIG. 8.
Figure 11:
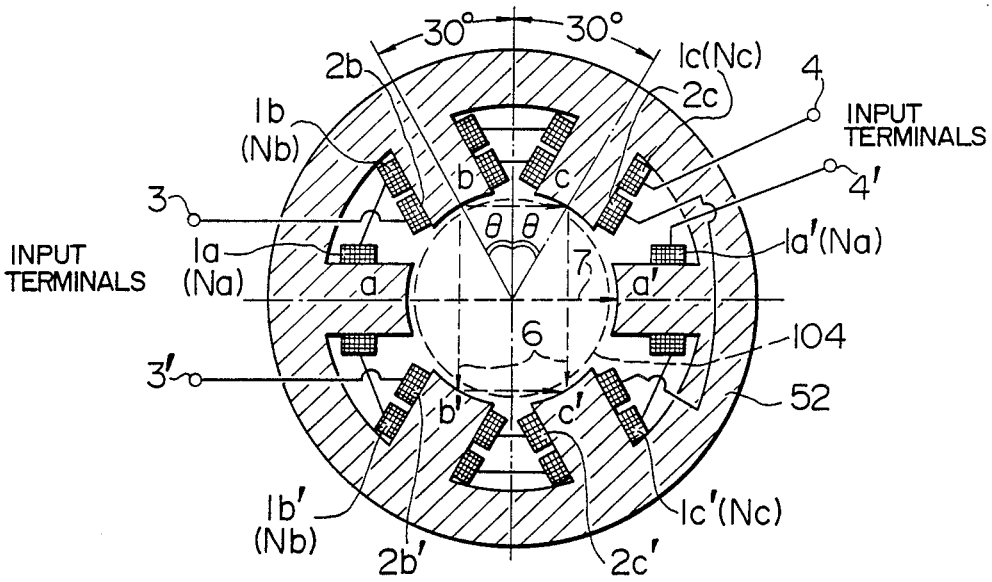
FIG. 11 is a sectional view showing a first embodiment of a convergence yoke of a convergence apparatus according to the present invention.

FIG. 11 is a sectional view showing a first embodiment of a convergence yoke of a convergence apparatus according to the present invention. In FIG. 11, the parts the same as or equivalent to those in FIGS. 4 and 8 are referenced correspondingly.

In FIG. 11, reference numerals 1*a*, 1*a*′, 1*b*, 1*b*′, 1*c*, 1*c*′ designate vertical deflection coils; 2*b*, 2*b*′, 2*c*, 2*c*′ designate horizontal deflection coils; 3, 3′, 4, 4′ designate input terminals; 52 designates a core; and a, a′, b, b′, c, c′ designate core protrusions.

As shown in FIG. 11, the core 52 has a ring-like portion and 6 rectangular core protrusions a, a′, b, b′, c, c′ which are provided equidistantly at circumferentially angular intervals of 60° on the inner circumference of the ring-like portion so as to inward project towards the center axis of the ring-like core 52.

The convergence yoke shown in FIG. 11 generates horizontal and vertical bipolar magnetic fields 7 and 6 crossing each other. Specifically, in order to generate the vertical bipolar magnetic field 6, the core protrusions b and c are disposed in pair in positions symmetrical with respect to the vertical axis and circumferentially separated by 30° from each other so as to form one magnetic pole and the core protrusions b′ and c′ are disposed in pair in positions symmetrical with respect to the vertical axis and circumferentially separated by 30° from each other so as to form the other magnetic pole. The coils 2*b*, 2*b*′, 2*c* and 2*c*′ are wound on the core protrusions b, c, b′ and c′ respectively so that the magnetic pole formed by the core protrusions b and c and the core protrusions b′ and c′ are reversed in polarity when a convergence correction current is made to flow across the input terminals 3 and 3′.

In the configuration, the bipolar magnetic field generated the two magnetic poles in the vertical direction becomes substantially even. This is because the respective core protrusions constituting the magnetic poles are disposed at positions respectively deviated by 30° from the vertical axis of symmetry. The barrel magnetic field component becomes stronger as the angle $\theta$ is made smaller than 30°, while the pincushion magnetic field component becomes stronger as the angle $\theta$ is made larger than 30°. Accordingly, it is ideal to select the angle $\theta$ to be 30°.

On the other hand, the magnetic poles constituting the horizontal bipolar magnetic field 7 can be arranged similarly to the case of the vertical bipolar magnetic field 6. In this case, however, the angular distance between the adjacent core protrusions constituting the horizontal and vertical magnetic fields respectively is so small, only 30°, that it becomes necessary to reduce the respective width of the core protrusions, the respective thickness of the coils and the respective width of the coil bobbins thereby causing a difficulty in practical use.

Accordingly, one magnetic pole is formed of the three core protrusions, that is the core protrusion a disposed on the horizontal axis of symmetry and the core protrusions b and b′ disposed on the opposite sides of the core protrusion a and each separated from the horizontal axis by 60°. That is, the core protrusions b and b′ disposed on the opposite sides of the core protrusion a are used commonly to constitute the horizontal magnetic field as well as the vertical magnetic field. The ratio of the number of turns of winding Na of the coil 1*a* wound on the core protrusion a to the number of turns of winding Nb of each of the coils 1*b* and 1*b*′ respectively wound on the core protrusions b and b′ is selected to be as shown in the following expression (3).

$$Nb/Na = \cos 60°/\cos 0° = \tfrac{1}{2}\ldots \quad (3)$$

Similar to the above case, with respect to the core protrusions a′, c and c′ disposed in opposition to the core protrusions a, b and b′ the number of turns of winding Nc of each of the coils 1*c* and 1*c*′ respectively wound on the core protrusions c and c′ disposed on the opposite sides of the core protrusion a′ to the ratio of the number of turns of winding Na of the coil 1*a*′ wound on the core protrusion a′ is selected to be as shown in the following expression (4).

$$Nc/Na = \cos 60°/\cos 0° = \tfrac{1}{2}\ldots \quad (b\ 4)$$

Then, as there occurs ampere turn (magnetomotive force) in proportion to magnetic path length, the magnetic field of the same size occurs. The coils 1*a*, 1*b* and *b*′ are connected to each other while the coils 1*a*′, 1*c* and 1*c*′ are connected to each other so that the magnetic pole constituted by the core protrusions a, b and b′ and magnetic pole constituted by the core protrusions a′, c and c′ are reversed in polarity to each other.

In this configuration, similarly to the case of the vertical bipolar magnetic field 6, the horizontal bipolar magnetic field 7 is a substantially even magnetic field. This is because the ratio of the number of turns of the winding of each of the coils 1*b* and 1*b*′ wound on the core protrusions b and b′ to the number of turns of the winding of the coil 1*a* wound on the core protrusion a is selected to be 178 , and the number of turns of winding of the coils 1*c* and 1*c*′ wound on each of the core protrusions c and c′ to the number of turns of winding of the coil 1a' wound on the core protrusion a' is also selected to be ½. If the number of turns of winding of each of the coils 1b and 1b' or each of the coils 1c and 1c' is increased, the pincushion component becomes large, while if that number of turns is decreased, the barrel component becomes large.

Figure 12:
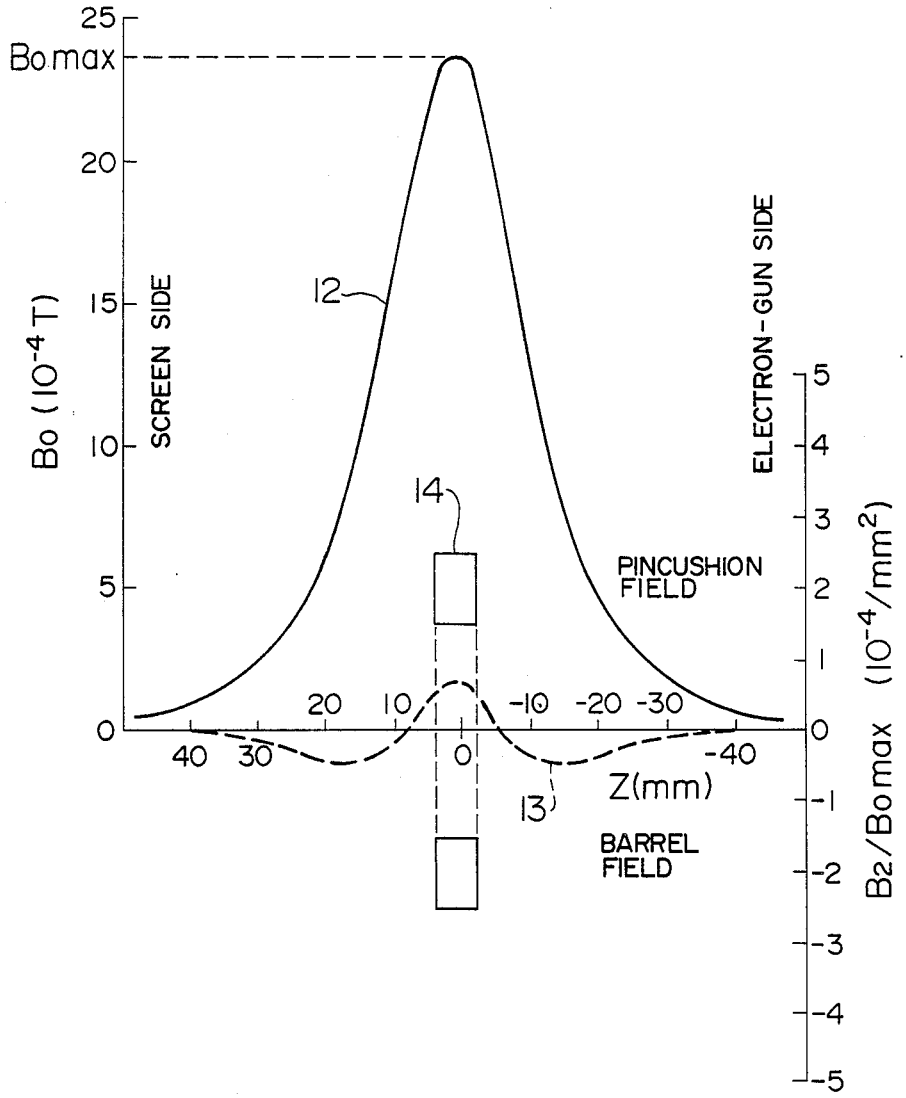
FIG. 12 is an explanatory diagram showing, along an tube axis, magnetic flux density and uneven magnetic field component distribution of a bipolar magnetic field generated in the convergence yoke of FIG. 11.

FIG. 12 is an explanatory diagram showing, along an tube axis, magnetic field density and uneven magnetic field component distribution of a bipolar magnetic field generated in the convergence yoke of FIG. 11.

In FIG. 12, the abscissa represents the coordinate Z in the direction of tube axis (in the direction perpendicular to the paper plane in FIG. 11), the axis of ordinates at the left side represents the magnetic flux density $B_0$ [$10^{-4}$ T]on the tube axis, and the axis of ordinates at the right side represents the value of $B_2/B_{0max}$ [$10^{-4}/mm^2$]which is obtained by normalizing the uneven magnetic field component $B_2$ with the maximum value $B_{0max}$ of the magnetic flux density $B_0$ on the tube axis. The reference numeral 12 represents the distribution curve of the magnetic flux density $B_0$, 13 represents the distribution curve of $B_2/B_{0max}$, and 14 represents the position, on the tube axis, of the core 52 of the convergence yoke.

As seen in FIG. 12, the value of $B_0$ is maximum at the center of the convergence yoke, and becomes smaller as the position comes away from the center toward the electron gun side or toward the fluorescent screen. On the other hand, the distribution curve of $B_2B_{0max}$ shows a weak pincushion magnetic field within the convergence yoke, while shows a weak barrel magnetic field before and after the convergence yoke. Accordingly, the magnetic field distribution is substantially even in general.

In this first embodiment, as described above, the vertical bipolar magnetic field is generated by the four core protrusions b, c, b', and c', that is, a pair of core protrusions b and c which are symmetrical with each other with respect to the vertical magnetic field symmetrical axis (vertical axis) and another pair of core protrusions b' and c' which are symmetrical with each other with respect to the same vertical axis, while the horizontal bipolar magnetic field is generated by the six core protursions a, b, b', a', c and c', that is, a set of the three core protusions a located on the horizontal magnetic field symmetrical axis (horizontal axis) and b and b' which are symmetrical with each other with respect to the same horizontal axis and another set of the three core protrusions a' located on the same horizontal axis and c and c' which are symmetrical with each other with respect to the same horizontal axis. Alternatively, however, the whole of the convergence yoke may be rotated by 90° so as to reverse the arrangements for the horizontal and vertical magnetic fields to each other.

Figure 13:
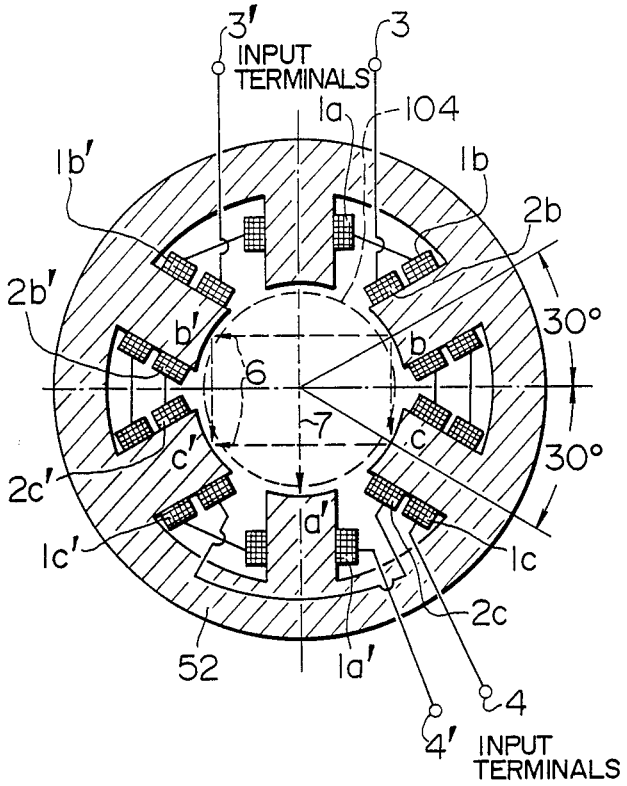
FIG. 13 is a sectional view showing a second embodiment of a convergence yoke of a convergence apparatus according to the present invention.

FIG. 13 illustrates a second embodiment of a convergence yoke of a convergence apparatus according to the present invention, in which the whole of the convergence yoke in the first embodiment is rotated by 90° so as to reverse the arrangements for the horizontal and vertical magnetic fields to each other. Being the same as that described with respect to FIG. 12, the operation of the second embodiment of FIG. 13 is not described here.

Figure 14:
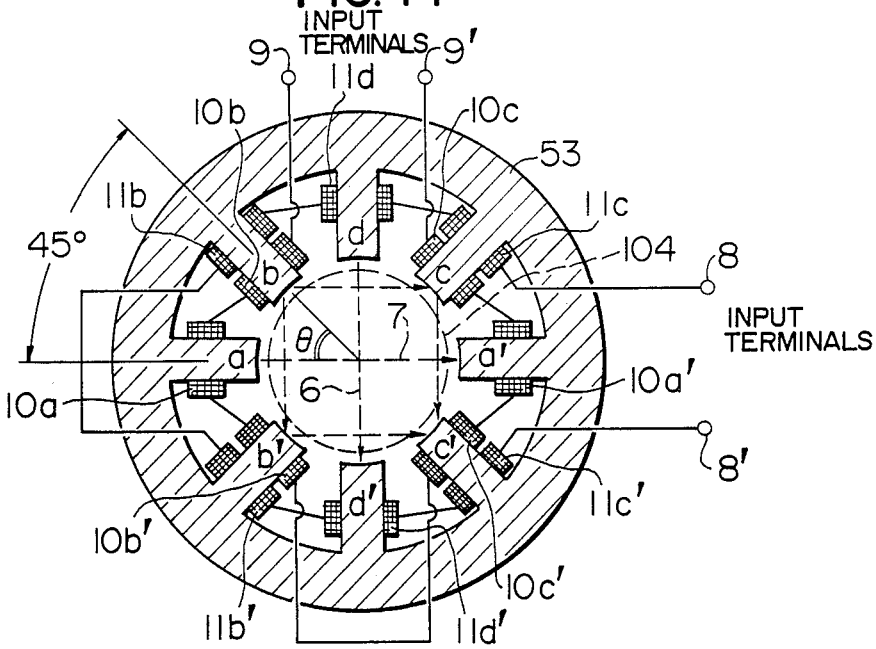
FIG. 14 is a sectional view showing a third embodiment of a convergence yoke of a convergence apparatus according to the present invention.

FIG. 14 is a sectional view showing a third embodiment of a convergence yoke of a convergence apparatus according to the present invention.

In FIG. 14, reference numerals 8, 8', 9, 9' designate input terminals; 10a, 10a', 10b, 10b', 10c, 10c' designate vertical deflection coils; 11b, 11b', 11c, 11c', 11d, 11d' designate horizontal deflection coils; 53 designates a core; and a, a', b, b', c, c', d, d' designate core protrusions.

As shown in FIG. 14, the core 53 has a ring-like portion and eight core protrusions a, b, c, d, a', b', c', d' which are provided equidistantly at circumferentially angular intervals of 45° on the inner circumference of the ring-like portion so as to inward project towards the center axis of the ring-like core 53. Of those eight core protrusions a, b, c, d, a', b', c', d', the pair of core protrusions a and a' are located on the horizontal magnetic field symmetrical axis (horizontal axis), while the pair of core protrusions d and d' are located on the vertical magnetic field symmetrical axis (vertical axis).

The opposite magnetic poles of the horizontal bipolar magnetic field 7 are constituted by the three core protrusions a, b and b' and the three core protrusions a', c and c' respectively, while the opposite magnetic poles of the vertical bipolar magnetic field 6 are constituted by the three core protrusions b, d and c and the three core protrusions b', d' and c'. The core protrusions b and c are arranged to be symmetrical with the core protrusions b' and c' respectively at 45° with respect to the horizontal magnetic field symmetrical axis (horizontal axis), while the core protrusions b and b' are arranged to be symmetrical with the core protrusions c and c' respectively at 45° with respect to the vertical magnetic field symmetrical axis (vertical axis). That is, the four core protrusions b, b', c and c' are commonly used to generate the horizontal and vertical magnetic fields. The number of the core protrusions and the connection of coils for constituting each magnetic pole in this third embodiment are the same as those for constituting each magnetic pole for generation of the horizontal bipolar magnetic field 7 in the above first embodiment. However, because the core protrusions b and b' and the core protrusions c and c' are located at the opposite sides of the core protrusions a and a' respectively at smaller angles of 45° in comparison with the first embodiment, the ratio of the number of turns of winding Nb of each of the coils wound on the core protrusions b, b', c and c' to the number of turns of winding Na of each of the coils wound on the core protrusions a, a', d and d' is selected to be as shown in the following expression (5).

$$Nb/Na = \cos 45°/\cos 0° = 1/\sqrt{2} \ldots \quad (5)$$

In the thus arranged magnetic pole configuration, each of the generated horizontal and vertical bipolar magnetic fields 7 and 6 is substantially even.

In the third embodiment, the magnetic flux density on the tube axis and the uneven magnetic field component of the generated bipolar magnetic fields are the same as those in the embodiment of FIG. 12.

Figure 7:
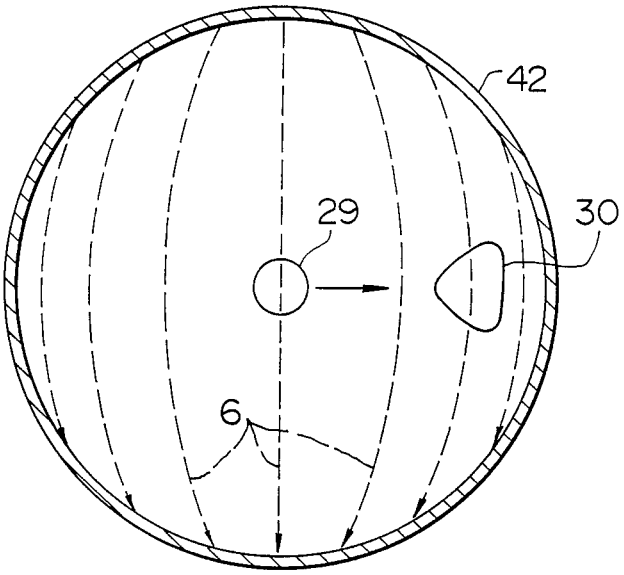
FIG. 7 PRIOR ART
FIG. 7 is an explanatory diagram showing a state in which a shape of an electron beam spot is distorted by a barrel magnetic field component of a bipolar magnetic field generated in the convergence yoke of FIG. 4.
Figure 10:
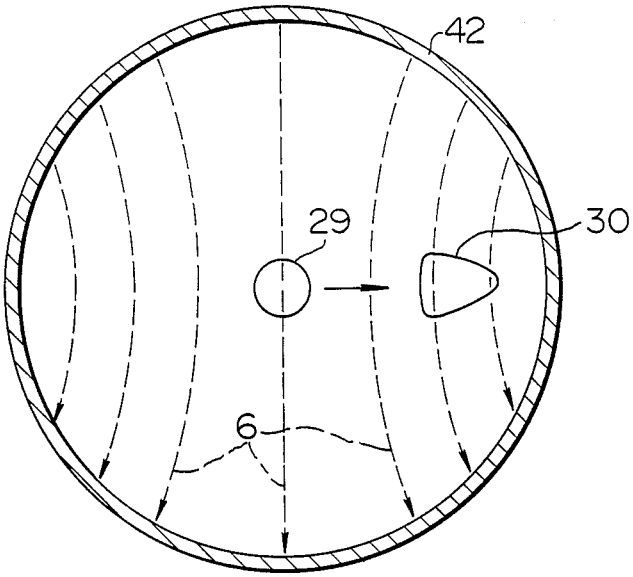
FIG. 10 PRIOR ART
FIG. 10 is an explanatory diagram showing a state in which a shape of an electron beam spot is distorted by a pincushion magnetic field component of a bipolar magnetic field generated in the convergence yoke of FIG. 8.

In the first, second and third embodiments, as described above, each of the horizontal and vertical bipolar magnetic fields can be made substantially even, so that such distortion in shape of the electron beam spot as shown in FIG. 7 or 10 can be reduced to thereby improve the focusing performance.

In the foregoing first, second and third embodiments,. as means for generating substantially even bipolar magnetic fields, the relation between the core protrusion attaching positions and the number of turns of winding of the coils is set as follows. That is, in the case where two core protrusions are used for each magnetic pole, the attaching positions of the two core protrusions are set at the opposite sides of the axis of symmetry of the magnetic field so as to be deviated by 30° from the axis of symmetry and the numbers of turns of winding on the respective core protrusions are made equal to each other. In the case where three core protrusions are used for each magnetic pole, the attaching positions of the respective core protrusions are set so that one of the three core protrusions is located at a position on the axis of symmetry of the magnetic field and the other two core protursions are located at positions equiangularly symmetrically deviated from the axis of symmetry of the magnetic field at the angle of $\theta$, and the value of ratio N of the number of turns of each of the coils wound on the two core protrusions on the positions symmetrical with respect to the axis of symmetry of the magnetic field to the number of turns of the coil wound on the core protrusion on the axis of symmetry is selected to be $$N=\cos\theta \ldots \quad (6)$$

Although the case where both the horizontal and vertical bipolar magnetic fields are made to be substantially even has been illustrated in the three embodiments described above, the present invention may be applied also to a convergence apparatus in which only one of the horizontal and vertical bipolar magnetic fields is made substantially even.

Further, it is a matter of cause that the case where the turn ratio of coils and the core protrusion mount angle are different a little from those in the above embodiments is included within the scope of the present invention so long as the difference does not cause any problem in performance for formation of a substantially even bipolar magnetic field. Particularly in the case where each magnetic pole is constituted by three core protrusions, it is possible to obtain a bipolar magnetic field having an optimum magnetic field shape in accordance with the sizes and shapes of the deflection yoke and the cathode-ray tube respectively, by desiredly changing the ratio of the number of turns of the coil wound on the core protrusion located on the magnetic field symmetry axis to the number of turns of the coil wound on each of the core protrusions located on the both sides of and symmetrically with respect to the magnetic field symmetry axis.

Further, the case where the magnetic field shape of the bipolar magnetic field is adjusted by changing the turn ratio of coils while the convergence correction currents passed through the respective coils are made equal to each other is illustrated in the above embodiments, it is a matter of cause that a bipolar magnetic field having the same magnetic field shape can be obtained even in the case where the ratio of the convergence correction currents passed through the respective coils is selected to have a value corresponding to the turn ratio of coils in the above embodiments while the numbers of turns of the coils are made equal to each other.

Figure 15:
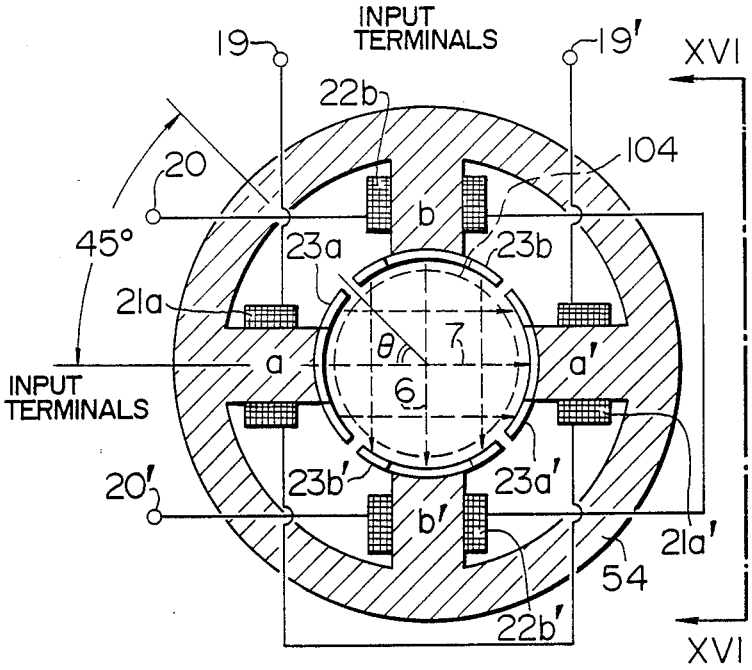
FIG. 15 is a sectional view showing a fourth embodiment of a convergence yoke of a convergence apparatus according to the present invention.
Figure 16:
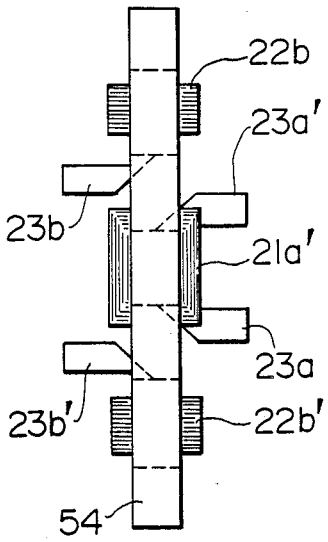
FIG. 16 is a side view in the direction of XVI—XVI in FIG. 15.
Figure 17:
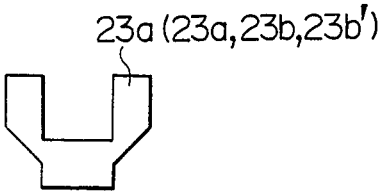
FIG. 17 is a plan view of the magnetic auxiliary plate shown in FIG. 15.

FIG. 15 is a sectional view showing a fourth embodiment of a convergence yoke of a convergence apparatus according to the present invention, FIG. 16 is a side view in the direction of XVI—XVI in FIG. 15 from the right side thereof, and FIG. 17 is a plan view of the magnetic auxiliary plate shown in FIG. 15.

In FIG. 15, reference numerals 19, 19', 20 and 20' designate input terminals; 21*a* and 21*a'* vertical deflection coils; 22*b* and 22*b'* designate horizontal deflection coils; 23*a*, 23*a'*, 23*b* and 23*b'* designate magnetic auxiliary plates; 54 designates a core; and a, a', b and b' designate core protrusions.

As shown in FIG. 15 which is a front view viewed in the direction of the tube axis, the core 54 is arranged in a manner so that the pair of core protrusions a and a' and the pair of core protrusions b and b' are located on the magnetic field symmetry axes, that is, the horizontal and vertical axes, respectively, so as to inward projected from the ring-like portion of the core 54. All the numbers of turns of the coils 21*a* and 21*a'* wound on the respective core protrusions a and a' located in opposition to each other and of the coils 22*b* and 22*b'* wound on the respective core protrusions b and b' located in opposition to each other are made equal. When convergence correction currents are made to flow between the input terminals 19 and 19' and between the input terminals 20 and 20' respectively, two bipolar magnetic fields are generated in the horizontal and vertical directions.

The magnetic auxiliary plates 23*a*, 23*a'*, 23*b* and 23*b'* each having a fork end shape as shown in FIG. 17 are attached on the front ends of the respective core protrusions a, a', b and b'. The width of the fork end of each of the magnetic auxiliary plates 23*a*, 23*a'*, 23*b* and 23*b'* is selected to fall within an angular range of 45° at maximum from the magnetic field symmetry axis (horizontal/vertical axis). The magnetic auxiliary plates 23*a* and 23*a'* provided on the respective core protrusions a and a' located on the horizontal axis are different in projecting direction from the magnetic auxiliary plates 23*b* and 23*b'* provided on the respective core protrusions b and b' located on the vertical axis.

In such a configuration, in the generated bipolar magnetic fields, the magnetic field components at the peripheral portions are emphasized by the magnetic flux components leaking from the fork end portion of each of the magnetic auxiliary plates 23*a*, 23*a'*, 23*b* and 23*b'* to the opposing magnetic pole to thereby reduce the barrel magnetic field component.

Figure 18:
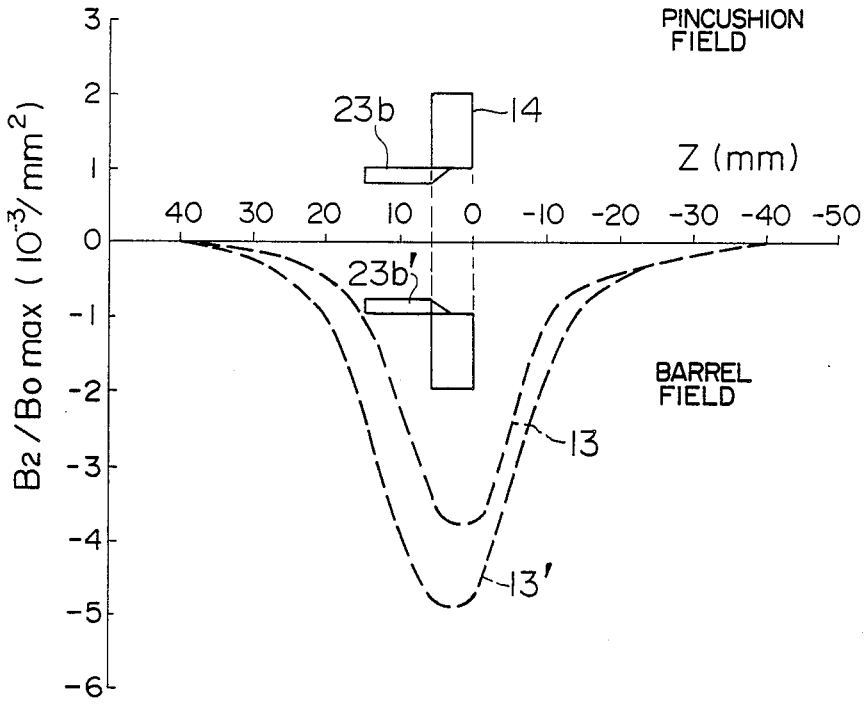
FIG. 18 is an explanatory view showing comparison of the distribution, along an tube axis, of an uneven magnetic field component of a bipolar magnetic field generated in the convergence yoke of FIG. 14 between the cases where the magnetic auxiliary plates are provided and not provided.

FIG. 18 is an explanatory view showing comparison of the distribution, along a tube axis, of an uneven magnetic field component of a bipolar magnetic field generated in the convergence yoke of FIG. 15 between the cases where the magnetic auxiliary plates are provided and not provided.

In FIG. 18, the reference numeral 13 represents the distribution curve of $B_2/B_{0max}$ in the case where the magnetic auxiliary plates are provided and 13' represents the distribution curve of $B_2/B_{0max}$ in the case where the magnetic auxiliary plates are not provided.

FIG. 18 clearly shows that the provision of the magnetic auxiliary plates 23*a*, 23*a'*, 23*b* and 23*b'* on the respective core protursions a, a', b and b' improves the value of $B_2/B_{0max}$ from the distribution curve 13' to the distribution curve 13' so as to reduce the barrel magnetic field component.

Also in this embodiment, therefore, the degree of distortion of the electron beam spot due to the generated bipolar magnetic field can be reduced to thereby improve the focusing performance more than the conventional convergence apparatus.

Since the projecting direction is made different between the magnetic auxiliary plates provided on the respective core protrusions located on the horizontal axis and the magnetic auxiliary plates provided on the respective core protrusions located on the vertical axis, the adjacent magnetic auxiliary plates do not come close to each other so that ineffective magnetic paths (magnetic paths generating magnetic flux which does not act on the electron beam) can be reduced to thereby prevent the reduction in deflection sensitivity of the convergence yoke.

According to the present invention, accordingly, the bipolar magnetic field generated by the convergence yoke can be made substantially even or can be improved in the direction to have a substantially even magnetic field shape, so that the distortion of the electron beam spot at the time of convergence correction can be reduced to thereby improve the focusing performance.

When the number of the core protrusions is increased, the air gap is reduced so that the effective core inner diameter is made small. Further, when the magnetic auxiliary plates projecting in the direction of the tube axis are provided, the effective magnetic field length (the magnetic field length in the direction of the tube axis, that is, the magnetic field length acting on the electron beam) is thereby elongated. These two features result in a remarkable effect in improvement in deflection sensitivity of the convergence yoke.

We claim:

1. A convergence apparatus comprising:

a ring-like core having a ring-like portion and a plurality of core protrusions provided on an inside surface of said ring-like portion so as to project beyond said ring-like portion toward the center of said ring-like core;

a plurality of coils respectively wound on said core protrusions;

a convergence circuit for supplying said coils with convergence correction currents;

said plurality of core protrusions being arranged so as to form at least two magnetic poles so that a bipolar magnetic field in the direction along at least one of a horizontal and a vertical axis of said core is generated by said two magnetic poles;

each of said at least two magnetic poles including a selected one of said plurality of core protrusions located on said at least one of said horizontal and said vertical axis and at least two additional core protrusions of said plurality of core protrusions located at positions equiangularly and symmetrically deviated from said at least one of said horizontal and said vertical axis; and wherein a ratio of an ampere turn of the coil wound on each of said at least two additional core protrusions to an ampere turn of the coil wound on said selected core protrusion is made variable so as to make adjustable an uneven magnetic field component of said bipolar magnetic field.

2. A convergence apparatus according to claim 1, wherein said at least two additional core protrusions are located at positions respectively deviated by an angle $\theta$ from at least one of said horizontal and vertical axis, and the value of said ratio is selected to be $\cos\theta$ so as to make substantially even the bipolar magnetic field to be generated.

3. A convergence yoke constituted by the core and the coils included in the convergence apparatus as defined in claim 1.

4. A convergence yoke constituted by the core and the coils included in the convergence apparatus as defined in claim 2.

5. A convergence apparatus according to claim 1, wherein said plurality of core protrusions are integral with said ring-like portion.

6. A convergence apparatus comprising:

a ring-like core having a ring-like portion and a plurality of core protrusions provided on an inside surface of said ring-like portion so as to project beyond said ring-like portion toward the center of said ring-like core;

a plurality of coils respectively wound on said core protrusions;

a convergence circuit for supplying said coils with convergence correction currents;

said plurality of core protrusions being arranged so as to form two magnetic poles so that a bipolar magnetic field in the direction along at least one of a horizontal and a vertical axis of said core is generated by said two magnetic poles;

each of said at least two magnetic poles including at least two core protrusions of said plurality of core protrusions located on positions equiangularly and symmetrically deviated from said at least one of said horizontal and said vertical axis, one of said at least two core protrusions being located as a reference at a position angularly divided by an angle $\theta_1$ from said at least one of said horizontal and said vertical axis, the other of said at least two core protrusions being located at a position angularly deviated by an angle $\theta$ from said at least one of said horizontal and said vertical axis; and wherein a ratio of an ampere turn of the coil wound on said other core protrusions to an ampere turn of the coil wound on said one core protrusion is selected to be $\cos\theta/\cos\theta_1$ so as to make substantially even the bipolar magnetic field to be generated.

7. A convergence yoke constituted by the core and the coils included in the convergence apparatus as defined in claim 6.

8. A convergence apparatus according to claim 6, wherein said plurality of core protrusions are integral with said ring-like portion.

9. A convergence apparatus comprising:

a ring-like core having a ring-like portion and six rectangular core protrusions provided at intervals of 60° on an inside surface of said ring-like portion so as to project beyond said ring-like portion toward the center of said ring-like core, a pair of said six core protrusions being located on at least one of a horizontal and a vertical axis of said core;

coils respectively wound on said six core protrusions;

a convergence circuit for supplying said coils with convergence correction currents;

said six core protrusions being arranged so as to form a first pair of magnetic poles and a second pair of magnetic poles so that a bipolar magnetic field in a direction of the one of said horizontal and vertical axes of said core is generated by said first pair of magnetic poles and another bipolar magnetic field in a direction of the other one of said horizontal and vertical axes is generated by said second pair of magnetic poles;

each of said first pair of magnetic poles including one of said pair of six core protrusions located on said one of said horizontal and vertical axes and two additional core protrusions of said six core protrusions, said two additional core protrusions being located at positions symmetrically deviated by 60° from said one of said horizontal and vertical axes;

a ratio of the number of turns of the coil wound on each of said two additional core protrusions to the number of turns of the coil wound on said one core protrusion being selected to be 1:2, said convergence correction currents respectively supplied to said coils wound on said one and said two additional core protrusions being made equal to each other, thereby making substantially even said bipolar magnetic field to be generated in said direction of said one of said horizontal and vertical axes;

each of said second pair of magnetic poles including a pair of said six core protrusions located at positions symmetrically deviated by 30° from said other of said horizontal and vertical axes; and the number of turns of said coils wound on said pair of core protrusions being selected to be equal to each other, said convergence correction currents respectively supplied to said coils wound on said pair of core protrusions being made equal to each other, thereby making substantially even said bipolar magnetic field to be generated in said direction of said other one of said horizontal and vertical axes.

10. A convergence yoke constituted by the core and the coils included in the convergence apparatus as defined in claim 9.

11. A convergence apparatus according to claim 9, wherein said six rectangular core protrusions are integral with said ring-like portion.

12. A convergence apparatus comprising:

a ring-like core having a ring-like portion and eight rectangular core protrusions provided at regular intervals of 45° on an inside surface of said ring-like portion so as to project beyond said ring-like portion toward the center of said ring-like core, a pair of said eight core protrusions being located on a horizontal axis of said core, and another pair of said eight core projections being located on a vertical axis of said core;

coils respectively wound on said eight core protrusions;

a convergence circuit for supplying said coils with convergence correction currents;

said eight core protrusions being arranged so as to form a first pair of magnetic poles and a second pair of magnetic poles so that a bipolar magnetic field in a direction of said horizontal axis is generated by said first pair of magnetic poles and another bipolar magnetic field in a direction of said vertical axis is generated by said second pair of magnetic poles;

each of said first pair of magnetic poles including one of said eight core protrusions located on said horizontal axis and a first pair of said eight core protrusions located at positions symmetrically deviated by 45° from said horizontal axis;

a ratio of the number of turns of the coil wound on each of said first pair of core protrusions to the number of turns of the coil wound on said one core protrusion being selected to be $1:\sqrt{2}$, said convergence correction currents respectively supplied to said coils wound on said one and said first pair core protrusions being made equal to each other, thereby making substantially even said bipolar magnetic field to be generated in said direction of said horizontal axis;

each of said second pair of magnetic poles including one of said eight core protrusions located on said vertical axis and at a second pair of said eight core protrusions located at positions symmetrically deviated by 45° from said vertical axis; and a ratio of the number of turns of the coil wound on each of said second pairs of core protrusions to the number of turns of the coil wound on said one of said eight core protrusions located on said vertical axis being selected to be $1:\sqrt{2}$, said convergence correction currents respectively supplied to said coils wound on said one of said eight core protrusions and said second pair of core protrusions being made equal to each other, thereby making substantially even said bipolar magnetic field to be generated in said direction of said vertical axis.

13. A convergence yoke constituted by the and the coils included in the convergence apparatus as defined in claim 12.

14. A convergence apparatus according to claim 12, wherein said eight rectangular core protrusions are integral with said ring-like portion.

15. A convergence apparatus comprising:

a ring-like core having a ring-like portion and a plurality of core protrusions provided on the inside of said ring-like portion so as to project from said ring-like portion toward the center of said ring-like portion;

coils wound on said core protrusions respectively and correspondingly;

a convergence circuit for supplying said coils with convergence correction currents respectively;

said core protrusions being arranged so as to form a first pair of magnetic poles and a second pair of magnetic poles so that a bipolar magnetic field in the direction of a horizontal axis of said core is generated by said first pair of magnetic poles and another bipolar magnetic field in the direction of a vertical axis of said core is generated by said second pair of magnetic poles;

each of said first pair of magnetic poles being constituted by a first one of said plurality of core protrusions located in an angular range symmetrically deviated by 45° from said horizontal axis;

a first magnetic auxiliary plate provided on said first core protrusion constituting each of said first pair of magnetic poles, said first magnetic auxiliary plate having a fork end projected along an axis perpendicular to said horizontal axis as well as said vertical axis, said first magnetic auxiliary plate having a width existing within said angular range symmetrically deviated by 45° from said horizontal axis, said first magnetic auxiliary plate having a substantially Y-shaped and axisymmetrical form;

each of said second pair of magnetic poles being constituted by a second one of said plurality of core protrusions located in an angular range symmetrically deviated by 45° from said vertical axis;

a second magnetic auxiliary plate provided on said second core protrusion constituting each of said second pair of magnetic poles, said second magnetic auxiliary plate having a fork end projected along an axis perpendicular to said horizontal axis as well as said vertical axis, said second magnetic auxiliary plate having a width existing within said angular range symmetrically deviated by 45° from said vertical axis, said second magnetic auxiliary plate having a substantially Y-shaped and axisymmetrical form; and said first magnetic auxiliary plate being made different from said second magnetic auxiliary plate in projecting direction of their fork end portions.

16. A convergence yoke constituted by the and coils included in the convergence apparatus as defined in claim 15.

* * * * *